US006738487B1

(12) United States Patent
Nageno et al.

(10) Patent No.: US 6,738,487 B1
(45) Date of Patent: May 18, 2004

(54) EARPHONE

(75) Inventors: Koji Nageno, Tokyo (JP); Hideki Seki, Saitama (JP); Naotaka Tsunoda, Tokyo (JP); Takashi Ohta, Saitama (JP)

(73) Assignee: Sony Corporation, Tokyo (JP)

( * ) Notice: Subject to any disclaimer, the term of this patent is extended or adjusted under 35 U.S.C. 154(b) by 523 days.

(21) Appl. No.: 09/586,534

(22) Filed: May 31, 2000

(30) Foreign Application Priority Data

May 31, 1999 (JP) ..... P11-152938

(51) Int. Cl.[7] ..... H04R 25/00

(52) U.S. Cl. ..... 381/322; 381/312

(58) Field of Search ..... 381/312, 322, 381/324, 328, 329, 330

(56) References Cited

FOREIGN PATENT DOCUMENTS

EP 0825796 * 2/1998

* cited by examiner

*Primary Examiner*—Minsun Oh Harvey
(74) *Attorney, Agent, or Firm*—Jay H. Maioli

(57) ABSTRACT

Obtaining a satisfactory feeling of mounting an earphone regardless of the user and achieving listening to reproduced acoustics with satisfactory sound quality is provided by an elastic auricle-mounting member surrounding a sound-discharging opening formed on a housing that accommodates a speaker unit. A space formed by the eardrum membrane, the speaker unit and the auricle-mounting member when a user wears the earphone on the auricle is communicated to the outside of the earphone via a ventilation resistor. Thus, it is possible to prevent deterioration in the sound quality attributable to pooled indistinct sound generated when the space encircled by the eardrum membrane, the speaker unit and the auricle-mounting member has been sealed.

6 Claims, 5 Drawing Sheets

SOUND PRESSURE FREQUENCY CHARACTERISTICS

SOUND PRESSURE FREQUENCY CHARACTERISTICS

SOUND PRESSURE FREQUENCY CHARACTERISTICS

EARPHONE

BACKGROUND OF THE INVENTION

1. Field of the Invention

The present invention relates to an earphone used by being mounted on an auricle, and relates more particularly to an earphone equipped with an auricle-mounting member having elasticity.

2. Description of Related Art

As an earphone to be used by being mounted on the auricle, there has been used a one that is equipped with an auricle-mounting member formed by elastic foamed polyurethane or the like at a portion of the earphone that is inserted into the recess of the auricle through to the external acoustic meatus. The earphone equipped with the auricle-mounting member at a portion to be inserted into the auricle can be mounted on the ear by inserting the auricle-mounting member into the recess of the auricle through to the external acoustic meatus. Therefore, the earphone can be securely mounted on the auricle. Further, as the auricle-mounting member is made of an elastic material, the auricle-mounting member can be easily deformed elastically to match the shape of the recess of the auricle to the external acoustic meatus. Thus, it is also possible to obtain satisfactory feeling of the mounting.

As explained above, the earphone fitted with the auricle-mounting member having elasticity is mounted on the ear by inserting the auricle-mounting member into the recess of the auricle through to the external acoustic meatus. When the auricle-mounting member has been mounted on the ear, the auricle-mounting member is elastically deformed to seal the recess of the auricle to the external acoustic meatus. As a result, there is formed a sealed space in the area encircled by the drum membrane, a speaker unit accommodated in the earphone main body and the auricle-mounting member. This sealed space functions as an acoustic space, and changes the sound-pressure frequency characteristics of the sound emitted from the speaker unit. Particularly, this sealed space substantially increases the sensitivity of the low-pass frequency band, and generates a pool of indistinct sound, which lowers the distinctness of the sound.

Further, when the elastic auricle-mounting member has been inserted into the recess of the auricle through to the external acoustic meatus, there are variations in the feeling of the mounting depending on persons and also depending on how the earphone is mounted on the auricle. There also arises a variation in the level of sealing. When even a slight variation has occurred in the sealing level, the sound-pressure frequency characteristics vary substantially. As a result, the sound quality varies depending on the user of the earphone.

In order to obtain a constant sound-pressure frequency regardless of the users of the earphone without an influence of the variation in the mounting state, there has been proposed a modified earphone. According to this earphone, small holes are made on a part of the housing that constitutes the main body of the earphone. When the earphone has been mounted on the ear, these small holes mitigate the sealing level of the space encircled by the drum membrane, a speaker unit accommodated in the earphone main body and the auricle-mounting member.

However, when only these small holes are made on a part of the housing, a resonance is generated in the intermediate-pass to high-pass frequency bands depending on the sizes of the small holes. As a result, a peak of sound pressure is generated in the intermediate-pass to high-pass frequency bands, and this deteriorates the sound-pressure frequency characteristics.

BRIEF SUMMARY OF THE INVENTION

It is, therefore, an object of the present invention to provide an earphone which provides a user with a satisfactory feeling of the wearing of the earphone when mounted on the auricle regardless of who uses this earphone, which can usually provide reproduced acoustics in satisfactory sound quality, and which does not change the listening sound quality regardless of users of the earphone.

In order to achieve the above object by solving the conventional problems, according to a first aspect of the present invention, there is provided an earphone comprising: a speaker unit; a housing that accommodates the speaker unit and that is formed with an opening for discharging sound from the front side of the speaker unit; and an elastic auricle-mounting member disposed surrounding the opening, wherein a space formed by the drum membrane, the speaker unit and the auricle-mounting member at the time of mounting the earphone on the auricle is communicated to the outside of the earphone via a ventilation resistor. Therefore, it is possible to prevent deterioration in the sound quality due to the pooled indistinct sound that is generated by sealing the space encircled by the drum membrane, the speaker unit and the auricle-mounting member.

As the space encircled by the drum membrane, the speaker unit and the auricle-mounting member is communicated to the outside of the earphone via the ventilation resistor, the generation of a resonance in the intermediate-pass to high-pass frequency bands can be restricted. As a result, it is possible to obtain flat sound-pressure frequency characteristics over the low-pass to high-pass bands as improved sound-pressure frequency characteristics.

Further, according to a second aspect of the invention, there is provided an earphone wherein the space formed by the drum membrane, the speaker unit and the auricle-mounting member at the time of mounting the earphone on the auricle is communicated to the outside of the earphone via ventilation holes made on the housing via the ventilation resistor.

Further, according to a third aspect of the invention, there is provided an earphone comprising: a speaker unit; a housing that accommodates the speaker unit and that is formed with an opening for discharging sound from the front side of the speaker unit; and an elastic auricle-mounting member disposed surrounding the opening, wherein a space formed by the drum membrane, the speaker unit and the auricle-mounting member at the time of mounting the earphone on the auricle is communicated to a space formed by a rear surface of the speaker unit and the housing via a ventilation resistor. Therefore, it is possible to prevent deterioration in the sound quality due to the pooled indistinct sound that is generated by the sealing of the space encircled by the drum membrane, the speaker unit and the auricle-mounting member.

DETAILED DESCRIPTION OF THE PREFERRED EMBODIMENTS

An earphone relating to the present invention will now be explained with reference to the drawings.

Figure 1:
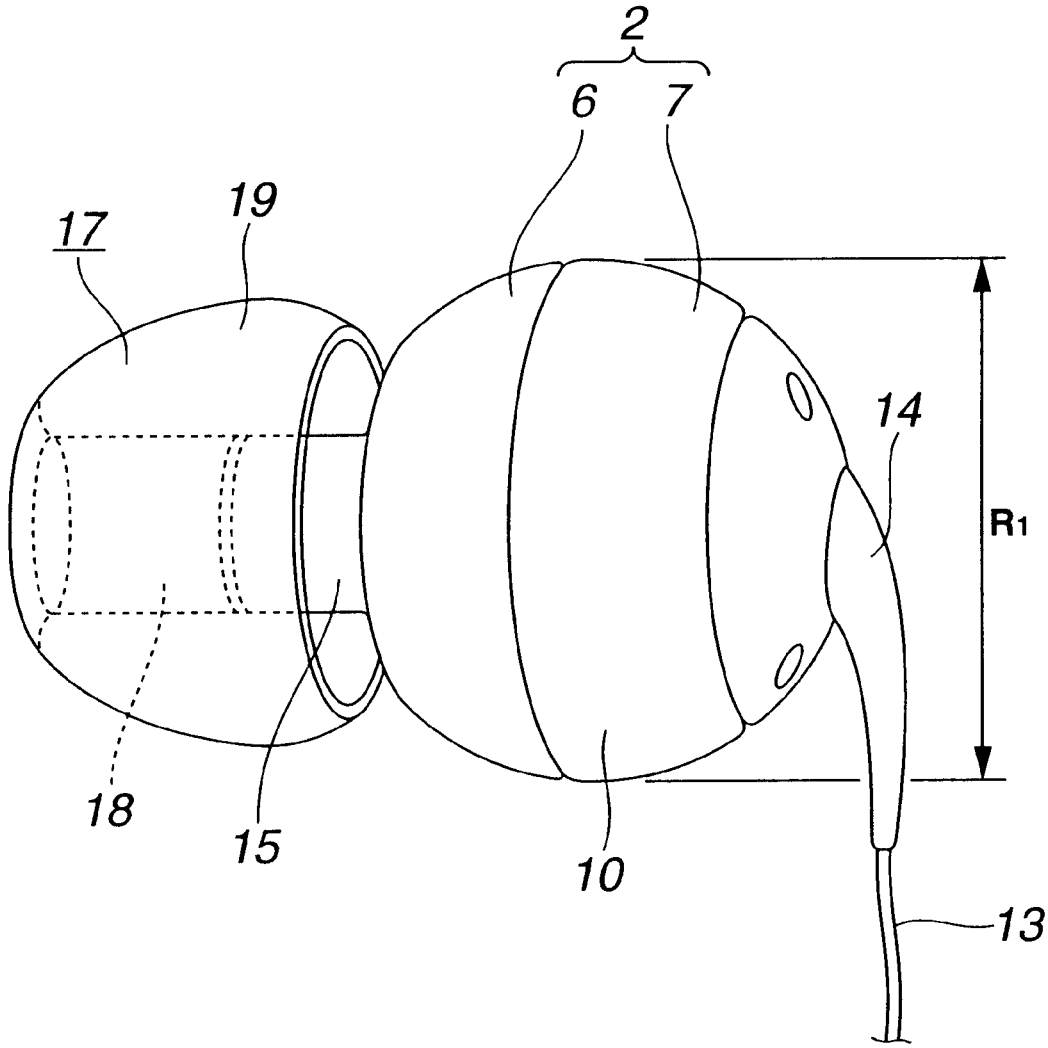
FIG. 1 is a perspective view of an earphone relating to the present invention.
Figure 2:
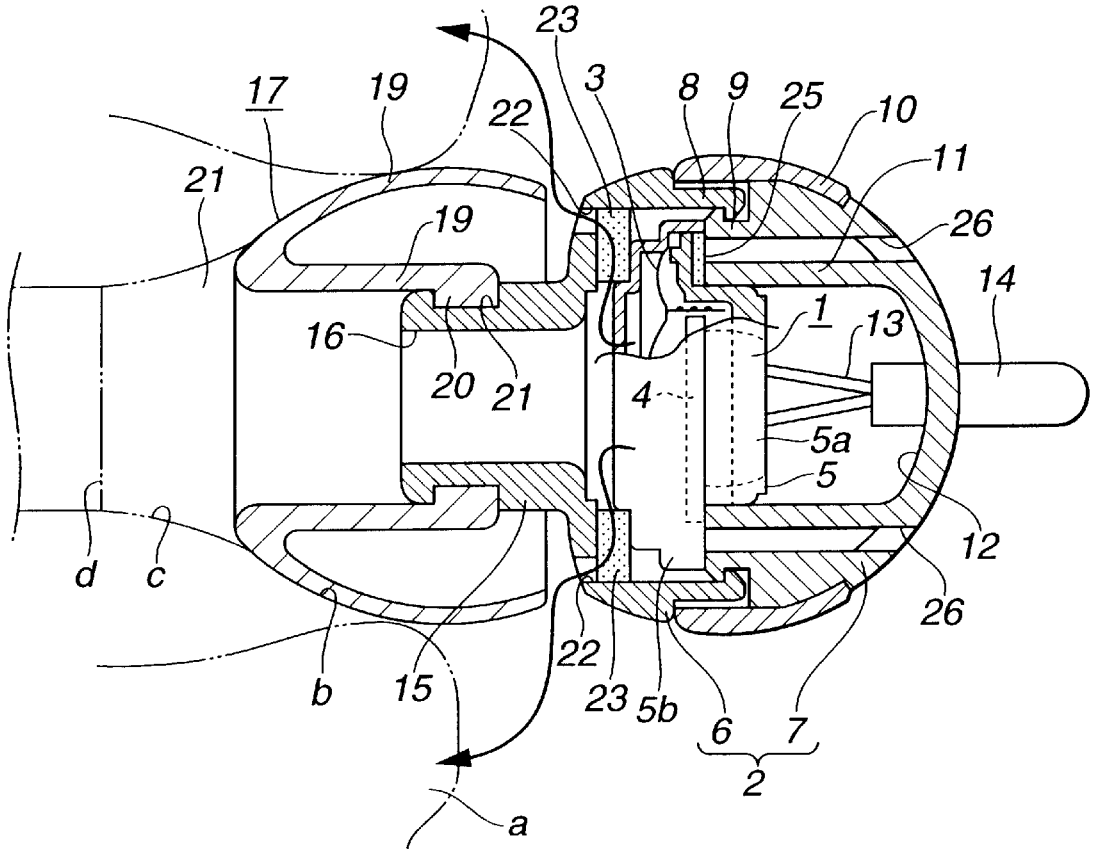
FIG. 2 is a cross-sectional view showing an internal structure of the earphone.

The earphone relating to the present invention includes a speaker unit 1 and a housing 2 that constitutes an earphone main body for accommodating the speaker unit 1, as shown in FIG. 1 and FIG. 2. The housing 2 is formed by a synthetic resin in an approximately spherical shape having a size to allow the earphone to be mounted on the recess of the auricle. The housing 2 is formed to have a diameter R1 of 9 to 11 mm.

The speaker unit 1 accommodated in the housing 2 has a vibration plate 3 and a magnetic circuit section 4 for vibrating the vibration plate 3 as shown in FIG. 2. The vibration plate 3 and the magnetic circuit section 4 are accommodated in an accommodation case 5. The accommodation case 5 has a magnetic circuit accommodating section 5*a* with a small diameter for accommodating the magnetic circuit 4, and a vibration plate accommodating section 5*b* with a larger diameter than that of the magnetic circuit accommodating section 5*a*. The magnetic circuit section 4 is fixedly installed on the magnetic circuit accommodating section 5*a*. The vibration plate 3 has its outer peripheral section supported by the vibration plate accommodating section 5*b*, and is installed so as to be movable toward and backward from the magnetic circuit section 4. A large number of small holes for transmitting sound emitted from the vibration plate 3 are formed on the front surface of the accommodation case 5 facing the vibration plate 3.

The housing 2 for accommodating the speaker unit 1 is constructed based on a butt connection between a front-half housing unit 6 and a rear-half housing unit 7, as shown in FIG. 2. The front-half housing unit 6 and the rear-half housing unit 7 are connected with each other by an engagement between claws 8 and 9 that are provided on the butt-connected surfaces. Thus, the housing 2 is constructed. The butt-connected portion between the front-half housing unit 6 and the rear-half housing unit 7 is sealed by a belt 10 that is wound around the outer periphery of the housing 2.

The speaker unit 1 is fixedly accommodated in the housing 2 by such an arrangement that the vibration plate accommodating section 5*b* of the accommodation case 5 is sandwiched between a speaker supporting section 11 provided inside the rear-half housing unit 7 and the inner-wall surface of the front-half housing unit 6 that is connected to the rear-half housing unit 7. As the housing 2 supports the speaker unit 1 via the speaker supporting section 11 provided inside the rear-half housing unit 7, a rear-surface side space 12 is formed between the rear surface of the speaker unit 1 and the rear-half housing unit 7, as shown in FIG. 2.

An external connection cord 13 is drawn out from the rear surface of the speaker unit 1 accommodated in the housing 2. The external connection cord 13 is pierced through a cord holder 14 provided on the rear surface of the rear-half housing unit 7 to face downward, and is drawn out from the housing 2, as shown in FIG. 1. When the earphone relating to the present invention is mounted on the auricle, the cord holder 14 restricts the direction in which the external connection cord 13 is drawn out, in engagement with a part of the auricle.

On the center of the front surface of the front-half housing unit 6, an auricle inserting section 15 is integrally formed in a cylindrical shape for insertion into the recess of the auricle through to the external acoustic meatus upon wearing the earphone on the auricle. An opening 16 formed on the auricle inserting section 15 works as a sound discharging section for discharging sound emitted from the front surface of the speaker unit 1 to the outside of the earphone. On the front end of the auricle inserting section 15, an auricle-mounting member 17 is disposed to cover the opening 16 formed on the auricle inserting section 15. The auricle-mounting member 17 has a cylindrical fitting section 18 for fitting the auricle inserting section 15 and an elastic displacement section 19 returned from the front end of the fitting section 18 toward the base end in an arc bent shape. The auricle-mounting member 17 is detachably installed on the auricle inserting section 15 by engaging a projection 20 formed on the inner periphery of the base of the fitting section 18 with a recess 21 formed on the outer periphery of the front end of the auricle inserting section 15.

The auricle-mounting member 17 is formed by an elastic material such as rubber or foamed polyurethane to easily seal the recess of the auricle through to the external acoustic meatus by elastically deforming along the recess of the auricle to the external acoustic meatus when a user wears the earphone on the auricle. The auricle-mounting member 17 shown in FIG. 1 and FIG. 2 can seal the recess of the auricle to the external acoustic meatus based on only the elastic deformation of the elastic displacement section 19 along the recess of the auricle through to the external acoustic meatus when a user wears the earphone on the auricle. Therefore, only the elastic deformation section 19 may be formed by an elastic material that can be easily deformed. When the auricle-mounting member 17 is integrally formed by the same material, the elastic displacement section 19 may be formed thinner than the fitting section 18 so as to be easily deformed elastically.

According to the earphone of the present example, the auricle inserting section 15 is provided on the housing 2, and the auricle-mounting member 17 is fitted to the auricle inserting section 15. However, it is also possible to install the auricle-mounting member 17 on the fitting section 18 that is directly engaged with the opening formed on the front surface of the front-half housing unit 6, without providing the auricle inserting section 15.

Further, the auricle-mounting member 17 may have simply the elastic member formed in a cylindrical shape so long as the elastic member can seal the recess of the auricle to the external acoustic meatus by easy elastic deformation along the recess of the auricle to the external acoustic meatus.

According to the above-described earphone having the auricle-mounting member 17 installed on it, when the earphone has been mounted on an auricle a as shown in FIG. 2, the auricle-mounting member 17 is elastically deformed along a recess b of the auricle a through to an external acoustic meatus c, thereby sealing the recess b of the auricle a to the external acoustic meatus c. Therefore, a sealed space 21 is formed by a drum membrane d, the speaker unit 1 and the auricle-mounting member 17. In order to communicate this sealed space 21 to the outside of the earphone, a plurality of ventilation holes 22 are formed on the front-half housing unit 6 of the housing 2. These ventilation holes 22 are formed at a position to make it possible to communicate the space 21 to the outside of the earphone without being covered by a part of the auricle a or the auricle-mounting member 17 when a user wears the earphone on the auricle a. In the present example, the ventilation holes 22 are made on the front surface where the fitting section 18 of the front-half housing unit 6 is provided. On the ventilation holes 22, a ventilation resistor 23 made of a porous elastic material such as foamed polyurethane or the like is provided. For this ventilation resistor 23, a pressed polyurethane sheet obtained by pressing the porous foamed polyurethane sheet to have adjusted breathability is used. More specifically, a foamed polyurethane sheet having a thickness of 0.7 mm in the natural state is compressed to have a thickness of 0.5 mm. This compressed polyurethane sheet is used for the ventilation resistor 23.

The ventilation resistor 23 is formed by punching the pressed polyurethane sheet into a ring shape. This is disposed within the housing 2 to have an engagement with the outer periphery of the sound discharging surface of the speaker unit 1. When the front-half housing unit 6 and the rear-half housing unit 7 are butt-connected with each other, the ventilation resistor 23 is sandwiched between the speaker unit 1 and the inner-wall surface of the front-half housing unit 6 so as to close the ventilation holes 22, as shown in FIG. 2. When the ventilation resistor 23 is disposed to close the ventilation holes 22, the sound discharged from the speaker unit 1 to the space 21 encircled by the drum membrane d, the speaker unit 1 and the auricle-mounting member 17 is leaked out to the earphone through the ventilation holes 22, with a leak resistance provided to the ventilation resistor 23.

Particularly, the use of the elastic polyurethane sheet for the ventilation resistor 23 makes it possible to have the ventilation resistor 23 sandwiched by compression between the speaker unit 1 and the front-half housing unit 6, with no gap generated between the speaker unit 1 and the front-half housing unit 6. Therefore, it is possible to securely transmit the sound discharged from the speaker unit 1 to the space 21 encircled by the drum membrane d, the speaker unit 1 and the,auricle-mounting member 17 to the ventilation holes 22 via the ventilation resistor 23 without a leakage of the sound.

The ventilation resistor 23 is disposed to provide a predetermined leak resistance to sound that leaks through the ventilation holes 22. Therefore, instead of sandwiching the ventilation resistor 23 between the speaker unit 1 and the inner-wall surface of the front-half housing unit 6, the ventilation resistor 23 may be disposed on the inner-wall surface of the front-half housing unit 6 with an adhesive so as to close the open end of the ventilation holes 22. Alternatively, the ventilation resistor 23 may be buried into the ventilation holes 22.

Figure 3:
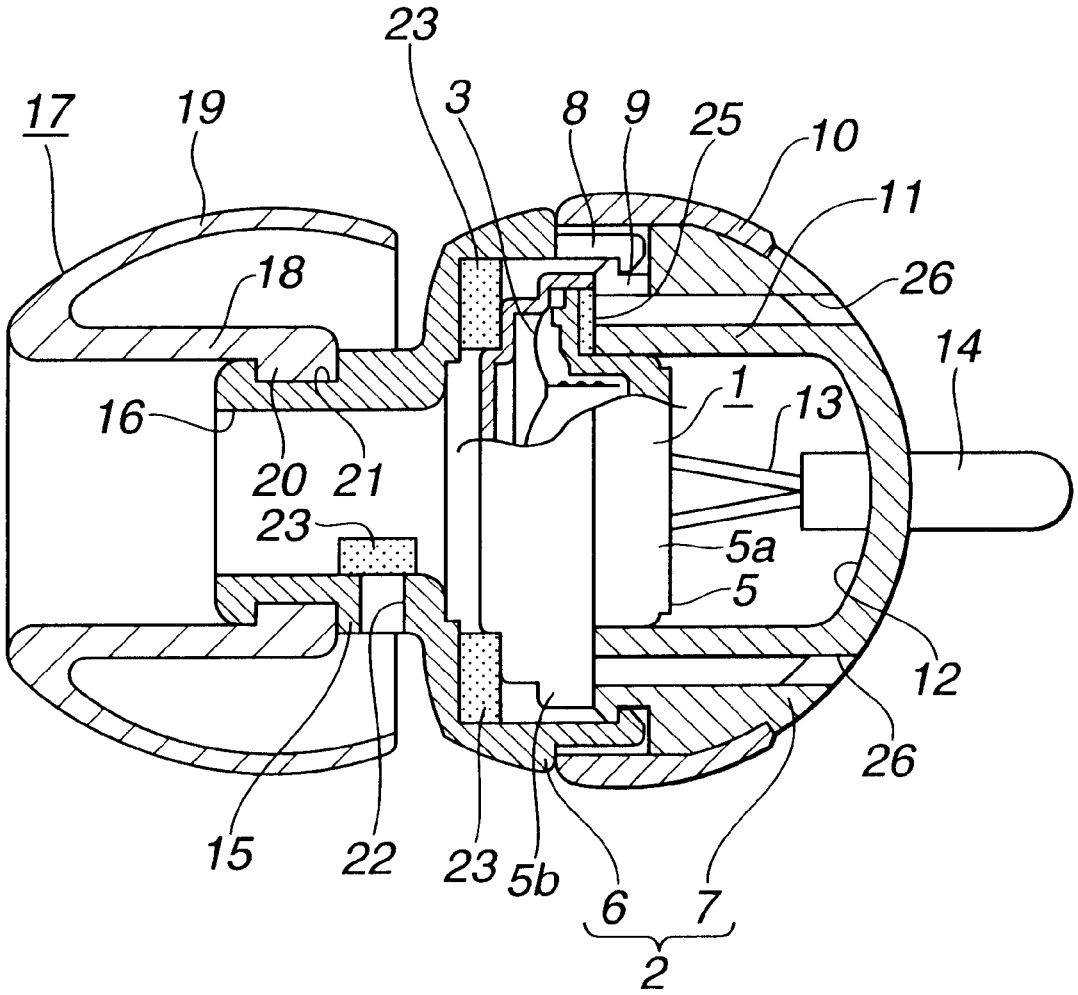
FIG. 3 is a cross-sectional view showing another example of an earphone relating to the present invention.

The ventilation holes 22 with the ventilation resistor 23 may be provided at a position where the space 21 encircled by the drum membrane d, the speaker unit 1 and the auricle-mounting member 17 is communicated to the outside of the earphone. Therefore, as shown in FIG. 3, the ventilation holes 22 may be provided on a part of the auricle inserting section 15 that faces the outside of the auricle without being covered by the auricle when mounted on the auricle. The ventilation resistor 23 may be adhered to the inner wall of the auricle inserting section 15 with an adhesive so as to cover the open end of the ventilation holes 22.

For the ventilation resistor 23, it is also possible to use non-woven fabric that functions as an acoustic resistor instead of the pressed polyurethane sheet. However, the use of a material not having elasticity like non-woven fabric has such a risk that when the ventilation resistor 23 is sandwiched between the speaker unit 1 and the inner surface of the front-half housing unit 6, a gap occurs between the speaker unit 1 and the inner surface of the front-half housing unit 6, which makes it impossible to obtain a complete sealing. When such a gap has occurred, the sound discharged from the speaker unit 1 leaks directly to the outside of the earphone via the gap. This deteriorates the low-pass acoustic characteristics. Therefore, when a material not having elasticity like non-woven fabric is used for the ventilation resistor 23, an adhesive is coated on the butt-connected surface between the speaker unit 1 and the inner surface of the front-half housing unit 6, thereby to prevent an occurrence of a gap.

Further, the earphone relating to the present invention may be arranged such that the sound discharged from the rear surface of the speaker unit 1 is leaked to the outside of the housing 12 via a ventilation resistor 25. In this case, ventilation holes 26 are made on the rear-half housing unit 7, thereby to close the open end of the ventilation holes 26 by the ventilation resistor 25, as shown in FIG. 2. The ventilation resistor 25 is formed in a ring shape, and this is disposed on the rear surface of the vibration plate accommodating plate **5*b* that is formed with small holes for discharging the sound from the speaker unit 1. When the front-half housing unit 6 and the rear-half housing unit 7 have been butt-connected with each other, the ventilation resistor 25 is disposed within the housing 2 by being sandwiched between the speaker supporting section 11 provided within the rear-half housing unit 7 and the speaker unit 1 thereby to close the ventilation holes 26. When the sound discharged to the rear surface of the speaker unit 1 is leaked to the outside of the earphone via the ventilation resistor 25**, it becomes possible to further improve the low-pass acoustic characteristics.

According to the above-described earphone, the space 21 encircled by the drum membrane d, the speaker unit 1 and the auricle-mounting member 17 is leaked out to the earphone through the ventilation holes 22 with the ventilation resistor 23. Alternatively, the auricle inserting section 15 that faces the outside of the auricle without being covered by the auricle when mounted on the auricle or a part or whole of the auricle-mounting member 17 may be formed by a material having a ventilation resistance. For forming the auricle inserting section 15 or a part of the auricle-mounting member 17 by the material having a ventilation resistance, a two-color molding method may be used.

Sound-pressure frequency characteristics of the earphone relating to the present invention and sound-pressure frequency characteristics of the prior-art earphone will be compared next.

Figure 4:
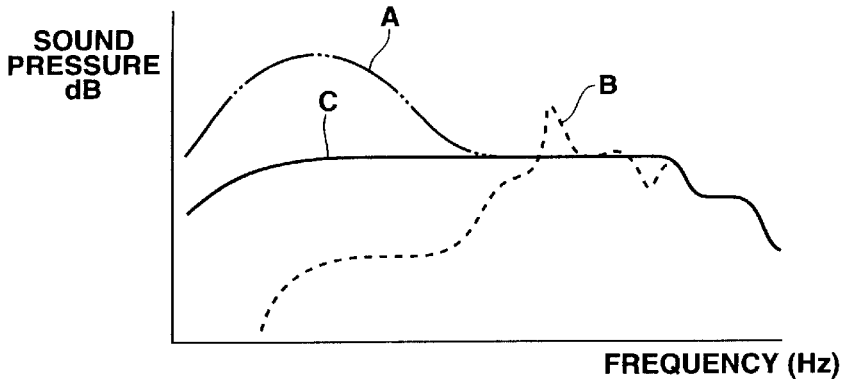
FIG. 4 is a sound-pressure frequency characteristic diagram showing sound-pressure frequency characteristics of the earphone relating to the present invention as compared with sound-pressure frequency characteristics of a prior-art earphone.

In the case of the earphone in the state that the space 21 encircled by the drum membrane d, the speaker unit 1 and the auricle-mounting member 17 has been sealed, the sound-pressure frequency characteristics obtained are such that the low-pass sound-pressure level is increased and the sound distinctness is lowered due to the pooled indistinct sound in the low-pass sound-pressure level, as shown by A in FIG. 4. In the case of the earphone in which the sealed space 21 encircled by the drum membrane d, the speaker unit 1 and the auricle-mounting member 17 is communicated to the outside of the earphone via only the ventilation holes, the sound-pressure frequency characteristics are such that a peak of sound-pressure level attributable to the resonance in the intermediate-pass frequency band occurs, and this deteriorates the sound quality, as shown by B in FIG. 4.

According to the earphone relating to the present invention, the low-pass sound-pressure level is improved, and it is possible to obtain flat sound-pressure frequency characteristics over wide frequency bands including the low-pass frequency band without generating a peak of sound-pressure level in the intermediate to wide frequency bands as shown by C in FIG. 4. Therefore, it is possible to listen to sound of high quality without a generation of pooled indistinct sound.

Figure 5:
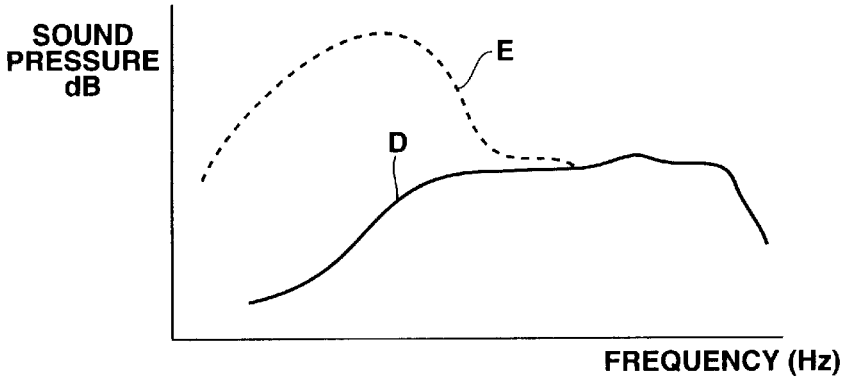
FIG. 5 is a sound-pressure frequency characteristics diagram showing sound-pressure frequency characteristics of the earphone relating to the present invention as compared with sound-pressure frequency characteristics of the prior-art earphone when a user wears the earphone on the auricle in different ways of wearing the earphone.

Further, in the case of the earphone in the state that the space 21 encircled by the drum membrane d, the speaker unit 1 and the auricle-mounting member 17 has been sealed, large variations occur in the sound-pressure frequency characteristics depending on the state of mounting the earphone on the auricle. When a user wears the earphone on the auricle in a state that the space 21 encircled by the drum membrane d, the speaker unit 1 and the auricle-mounting member 17 has been completely sealed, the sound-pressure frequency characteristics obtained are as shown by D in FIG. 5. When a user wears the earphone on the auricle in the state that a gap is generated between the auricle-mounting member 17 and the auricle, the sound-pressure frequency characteristics obtained are as shown by E in FIG. 5. Thus, the sound-pressure frequency characteristics change substantially depending on the state of mounting the earphone on the auricle.

Figure 6:
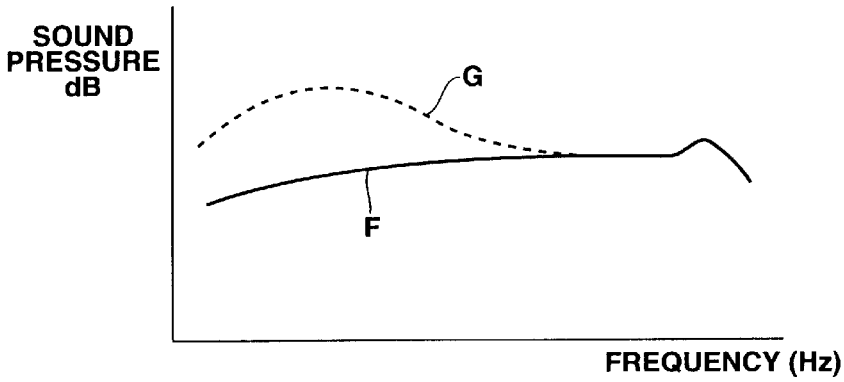
FIG. 6 is a sound-pressure frequency characteristics diagram showing sound-pressure frequency characteristics of the earphone relating to the present invention when a user wears the earphone on the auricle in different ways of wearing the earphone.

On the other hand, according to the earphone relating to the present invention, when the space 21 encircled by the drum membrane d, the speaker unit 1 and the auricle-mounting member 17 is in a completely sealed state when a user wears the earphone on the auricle, the sound-pressure frequency characteristics obtained are as shown by F in FIG. 6. When a gap is generated between the auricle-mounting member 17 and the auricle when a user wears the earphone on the auricle, the sound-pressure frequency characteristics obtained are as shown by G in FIG. 6. Thus, it is possible to obtain approximately constant sound-pressure frequency characteristics regardless of the state of mounting the earphone on the auricle.

The earphone relating to the present invention is structured such that the sound discharged to the sealed space 21 encircled by the drum membrane d, the speaker unit 1 and the auricle-mounting member 17 is leaked to the outside of the earphone via the ventilation resistor 23. Therefore, it is possible to listen to the external acoustic incident from the outside of the earphone via the ventilation resistor 23. It is also possible to structure an earphone with improved sealing of the housing 2 that accommodates the speaker unit 1 and also with satisfactory sound-pressure frequency characteristics by restricting a peak of sound-pressure level attributable to the resonance generated in the intermediate to high-pass frequency bands while improving the low-pass sound-pressure frequency characteristics.

Figure 7:
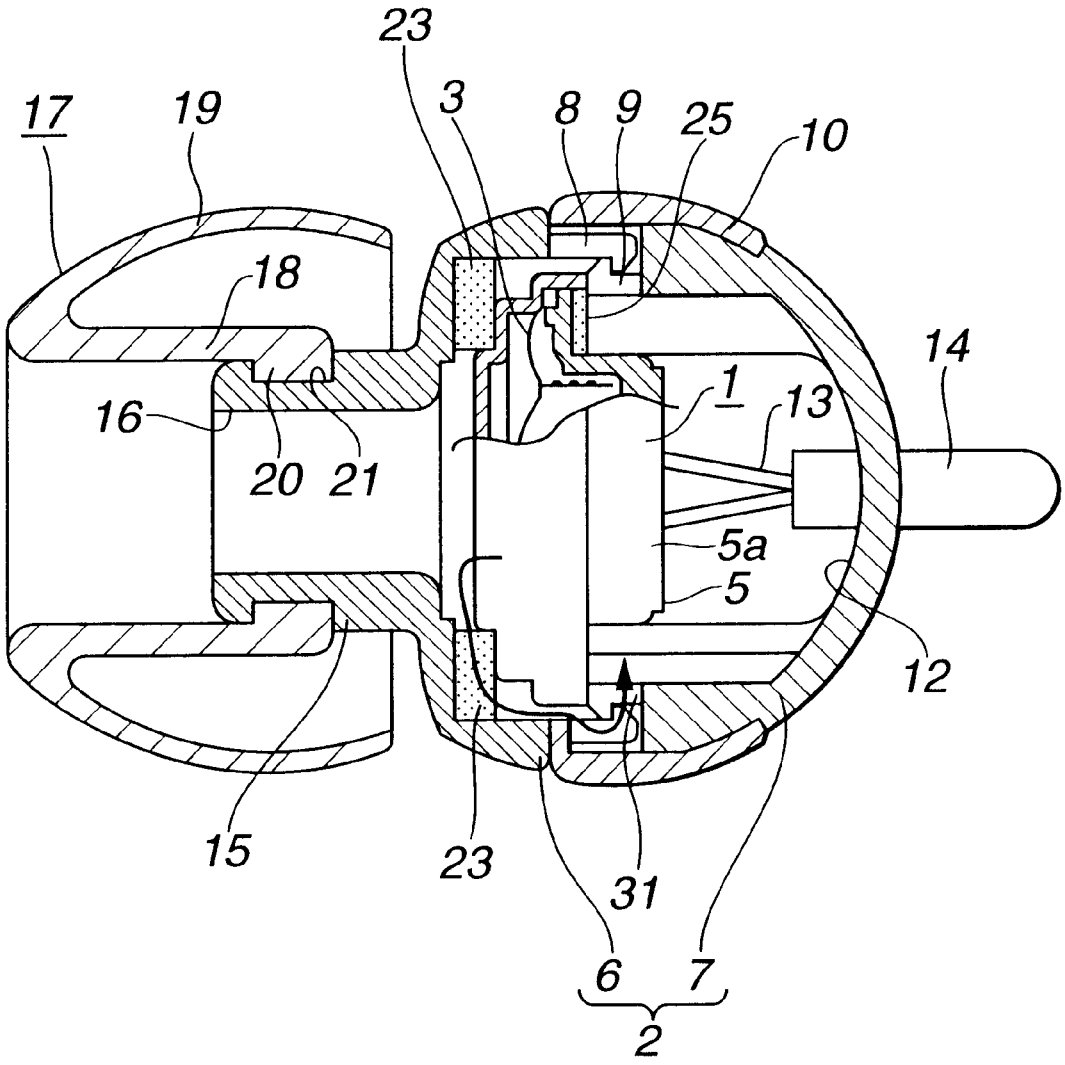
FIG. 7 is a cross-sectional view showing still another example of an earphone relating to the present invention.

FIG. 7 shows an earphone that can obtain satisfactory sound-pressure frequency characteristics with improved sealing of the housing 2. The basic construction of the earphone is similar to that of the earphone as shown in FIG. 1 and FIG. 2, except that the inside of the housing 2 is sealed without providing the ventilation holes 22 or 26 having the ventilation resistors 23 or 25 in the housing 1.

Between the butt-connected portion between the front-half housing unit 6 and the rear-half housing unit 7 that constitute the housing 2 and the outer periphery of the speaker unit 1, the sound discharged to the sealed space 21 encircled by the drum membrane d, the speaker unit 1 and the auricle-mounting member 17 is transmitted to the rear-surface side space 12 that is formed on the rear-half housing unit 7.

This earphone also has the ventilation resistor 23 sandwiched between the speaker unit 1 and the inner wall of the front-half housing unit 6. Based on the provision of the ventilation resistor 23 and a gap 31, the sound discharged to the sealed space 21 encircled by the drum membrane d, the speaker unit 1 and the auricle-mounting member 17 is leaked to the ventilation resistor 23 and is then discharged to the rear-surface side space 12 having a large capacity via the gap 31. Of the sound discharged to the rear-surface side space 12, particularly the sound in the low-pass frequency band is absorbed by an acoustic amplitude of an inverse phase discharged to the rear surface of the speaker unit 1. Thus, the increase in the sound-pressure level in the low-pass frequency band is prevented. The sound discharged to the sealed space 21 encircled by the drum membrane d, the speaker unit 1 and the auricle-mounting member 17 is leaked to the rear-surface side space 12 via the ventilation resistor 23. Therefore, the occurrence of the pooled indistinct sound can be cancelled, and it is possible to obtain sound-pressure frequency characteristics with satisfactory sound quality.

This earphone also has the ventilation resistor 25 disposed on the rear surface of the speaker unit 1. Thus, a ventilation resistance is provided to the sound discharged from the rear surface of the speaker unit 1, thereby to control sound-pressure frequency characteristics.

What is claimed is:

1. An earphone comprising a speaker unit;

a housing for accommodating the speaker unit and being formed with an opening for discharging sound from a front side of the speaker unit; and and elastic auricle-mounting member disposed surrounding the opening formed in the housing, wherein a space formed by an eardrum membrane of a user, the speaker unit and the elastic auricle-mounting member at a time of mounting the earphone on an auricle of the user is communicated to an exterior of the earphone via a ventilation resistor, and wherein the space formed by the eardrum membrane, the speaker unit and the auricle-member at the time of mounting the earphone on the auricle is communicated to a space formed by a rear surface of the speaker unit and the housing via a second ventilation resistor.

2. The earphone according to claim 1, wherein the space formed by the eardrum membrane, the speaker unit and the elastic auricle-mounting member at the time of mounting the earphone on the auricle is communicated to the exterior of the earphone via ventilation holes formed in the housing via the ventilation resistor.

3. The earphone according to claim 1, wherein the ventilation resistor is formed in a ring shape by an elastic material having air permeability, and the ventilation resistor is sandwiched in, a compressed state between the speaker unit and an inner-wall surface of the housing.

4. The earphone according to claim 1, wherein the ventilation resistor is formed in a ring shape by an elastic material having air permeability, the ventilation resistor is sandwiched in a compressed state between the speaker unit and an inner-wall surface of the housing, and the space is communicated to the outside of the earphone via ventilation holes formed in the housing via the ventilation resistor.

5. The earphone according to claim 1, wherein the ventilation resistor is formed in a ring shape by a compressed foamed polyurethane sheet having air permeability, and the ventilation resistor is sandwiched in a compressed state between the speaker unit and an inner-wall surface of the housing.

6. The earphone according to claim 1, wherein the ventilation resistor is formed in a ring shape by a compressed foamed polyurethane sheet having air permeability, the ventilation resistor is sandwiched in a compressed state between the speaker unit and an inner-wall surface of the housing, and the space is communicated to the outside of the earphone via ventilation holes formed in the housing via the ventilation resistor.

* * * * *